US009502008B2

(12) United States Patent
Everly

(10) Patent No.: US 9,502,008 B2
(45) Date of Patent: Nov. 22, 2016

(54) METHODS AND APPARATUS FOR IMPROVING DECIBEL LEVEL DECAY RATES OF EXCITED STRINGS

(71) Applicant: Phillip Jason Everly, North Hollywood, CA (US)

(72) Inventor: Phillip Jason Everly, North Hollywood, CA (US)

( * ) Notice: Subject to any disclaimer, the term of this patent is extended or adjusted under 35 U.S.C. 154(b) by 0 days.

(21) Appl. No.: 14/602,068

(22) Filed: Jan. 21, 2015

(65) Prior Publication Data

US 2016/0210939 A1 Jul. 21, 2016

(51) Int. Cl.
*G10D 3/10* (2006.01)

(52) U.S. Cl.
CPC ..... *G10D 3/10* (2013.01)

(58) Field of Classification Search
CPC ..... G10D 3/10; G10D 1/00; G10D 1/005; D07B 2801/22; D07B 2205/10; D07B 2205/2046; C22C 38/02; G10C 3/06; Y10T 428/2933; Y10T 428/2936; Y10T 428/294; Y10T 428/31544; A63B 51/02; C23C 14/12
USPC ..... 84/297 S, 297 R
See application file for complete search history.

(56) References Cited

U.S. PATENT DOCUMENTS 7,531,730 B2 * 5/2009 Everly ..... G10D 3/10 84/199
2014/0348349 A1 * 11/2014 Nagaoka ..... H04R 1/288 381/162

* cited by examiner

*Primary Examiner* — Kimberly Lockett
(74) *Attorney, Agent, or Firm* — Buche & Associates, P.C.; John K. Buche; Bryce A. Johnson

(57) ABSTRACT

Methods and apparatus for improving the decibel level decay characteristics of excited strings for stringed musical instruments.

5 Claims, 4 Drawing Sheets

| ITEM | SERIAL NUMBER |
|---|---|
| Larson Davis 2200C PreAmp Power Supply | 0828 |
| Larson Davis PRM902 Microphone PreAmp | 0411 |
| Bruel & Kjaer 4165 Microphone | 732091 |
| Bruel & Kjaer 4230 Calibrator | 861608 |

FIG. 1

| Excitation | Uncoated | Coated | B52s | Cobalt |
|---|---|---|---|---|
| 1 | 56.10 | 56.13 | 58.67 | 54.78 |
| 2 | 56.68 | 56.39 | 58.82 | 54.78 |
| 3 | 56.61 | 56.38 | 58.95 | 55.57 |
| 4 | 56.62 | 56.55 | 58.56 | 54.89 |
| 5 | 56.11 | 56.93 | 58.98 | 55.00 |
| Average | 56.4 | 56.5 | 58.8 | 55.0 |
| Standard Deviation | 0.29 | 0.29 | 0.19 | 0.33 |

FIG. 2

| Excitation | Uncoated | Coated | B52s | Cobalt |
|---|---|---|---|---|
| 1 | 51.31 | 50.26 | 51.78 | 50.54 |
| 2 | 50.27 | 50.42 | 51.88 | 50.49 |
| 3 | 49.91 | 50.80 | -- | 50.03 |
| 4 | 51.90 | 50.63 | 50.24 | 49.90 |
| 5 | 51.47 | 50.83 | 51.92 | 50.67 |
| Average | 51.0 | 50.6 | 51.5 | 50.3 |
| Standard Deviation | 0.84 | 0.25 | 0.81 | 0.34 |

FIG. 3

| Excitation | Uncoated | Coated | B52s | Cobalt |
|---|---|---|---|---|
| 1 | 49.18 | 49.58 | 51.06 | 50.54 |
| 2 | 49.03 | 49.38 | 50.64 | 47.81 |
| 3 | 49.28 | 48.65 | 51.28 | 45.93 |
| 4 | 49.00 | 48.67 | 51.34 | 47.16 |
| 5 | 48.38 | 48.19 | 51.57 | 47.19 |
| Average | 49.0 | 48.9 | 51.2 | 47.73 |
| Standard Deviation | 0.35 | 0.57 | 0.35 | 1.72 |

FIG. 4

METHODS AND APPARATUS FOR IMPROVING DECIBEL LEVEL DECAY RATES OF EXCITED STRINGS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This document is in the field of methods and apparatus for improving decibel level decay rate characteristics of excited strings of stringed musical instruments.

2. Background

Strings of stringed musical instruments produce sound while vibrating. More specifically, a vibrating string sets air molecules into motion in the form of a sound wave defined by an alternating pattern of relatively high pressure compressions (where air molecules are compressed into a small region of space) and relatively low pressure rarefactions (where air molecules are spread apart). These vibrations decay over time, and so does the sound wave, which reduces the sound wave's perceived loudness.

The loudness of a string's sound wave can be increased by increasing either: (a) the wave's sound pressure or acoustic pressure (i.e., the local pressure deviation from the ambient (e.g., average or equilibrium) atmospheric pressure); or (b) increasing the wave's duration (i.e., improving the decibel level decay rate). Both the pressure and duration of a vibrating string's sound can be increased by increasing the force that causes vibration. However, applying a larger force to strings can damage the strings. Thus, a need exists for increasing either the vibrating string's sound pressure level or its duration without the need for increased force.

SUMMARY OF THE INVENTION

Therefore, it is an objective of this document to disclose methods and related apparatus for improving the decibel level decay rate of a vibrating string without increasing the force necessary to cause vibration. In one embodiment, the disclosed method comprises the step of coating a string in a solution of fluorochemical acrylate polymer with a thickness of less than one micron. In a preferred embodiment the string is treated with a clear, low viscosity solution of a fluorochemical acrylate polymer coating carried in a hydrofluoroether solvent. The solvent is non-flammable and contains no volatile organic compounds. The coating results in a film that has low surface energy values and a thickness of less than one micron.

BRIEF DESCRIPTION OF THE FIGURES

Other objectives of the disclosure will become apparent to those skilled in the art once the invention has been shown and described. The manner in which these objectives and other desirable characteristics can be obtained is explained in the following description and attached figures in which:

FIG. 1 is an itemization of testing equipment;

FIG. 2 is a chart of average maximum decibel levels for string tests on a 46E string;

FIG. 3 is a chart of average maximum decibel levels for string tests on a 36A string;

FIG. 4 is a chart of average maximum decibel levels for string tests on a 26D string;

Figure 5:
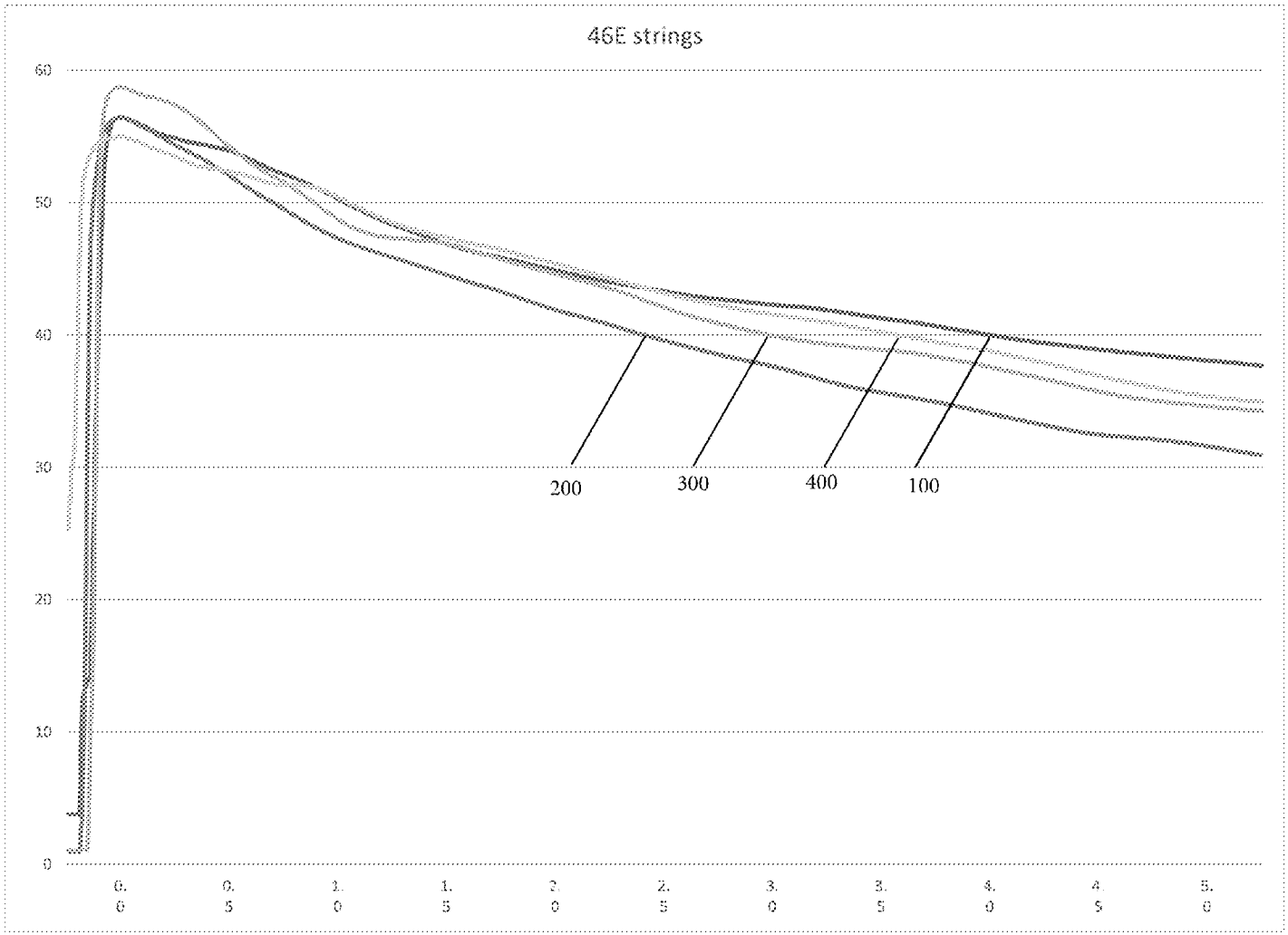
FIG. 5 is a plot of decibel levels versus time for 46E strings.
Figure 6:
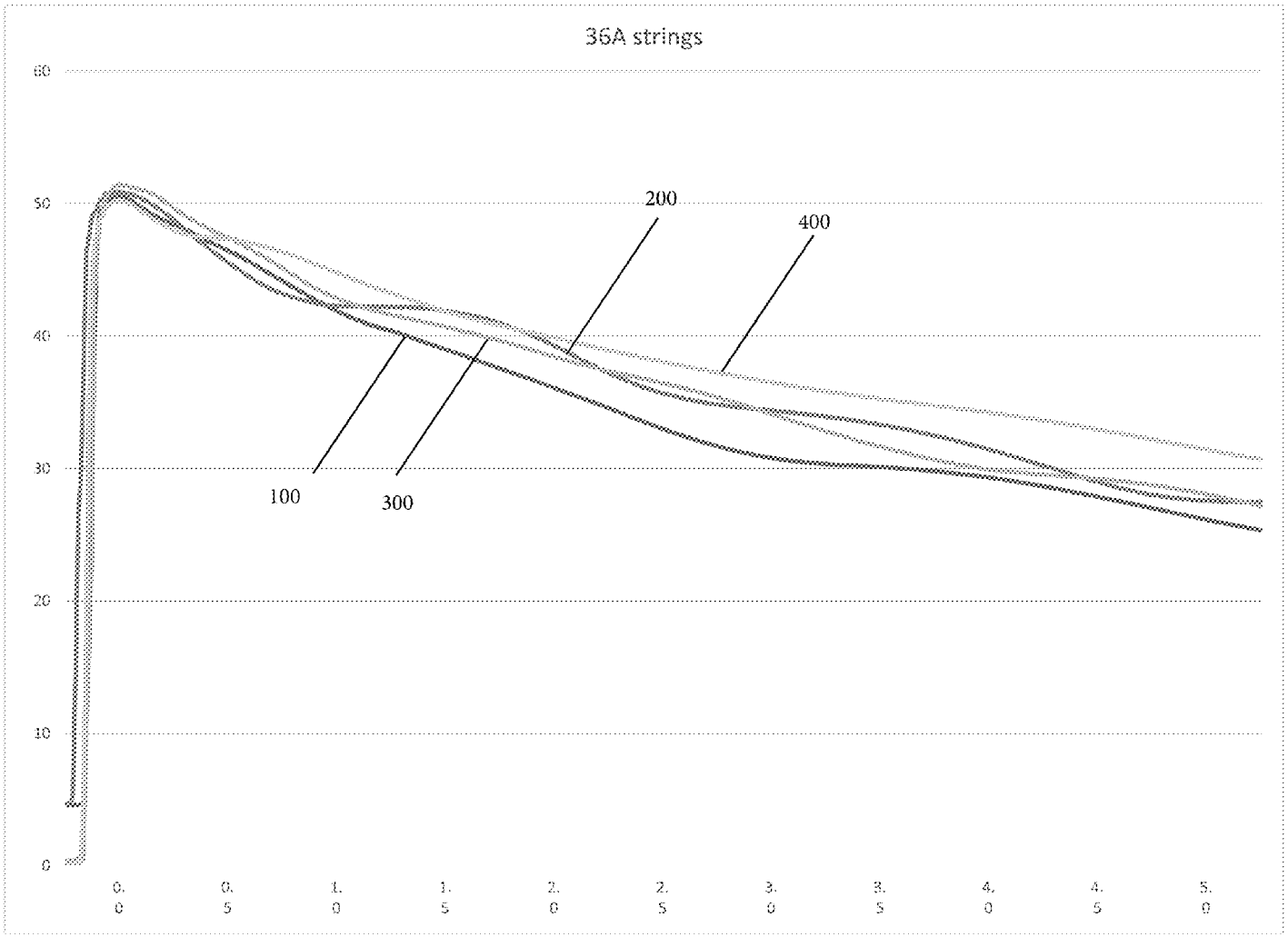
FIG. 6 is a plot of decibel levels versus time for 36A strings.
Figure 7:
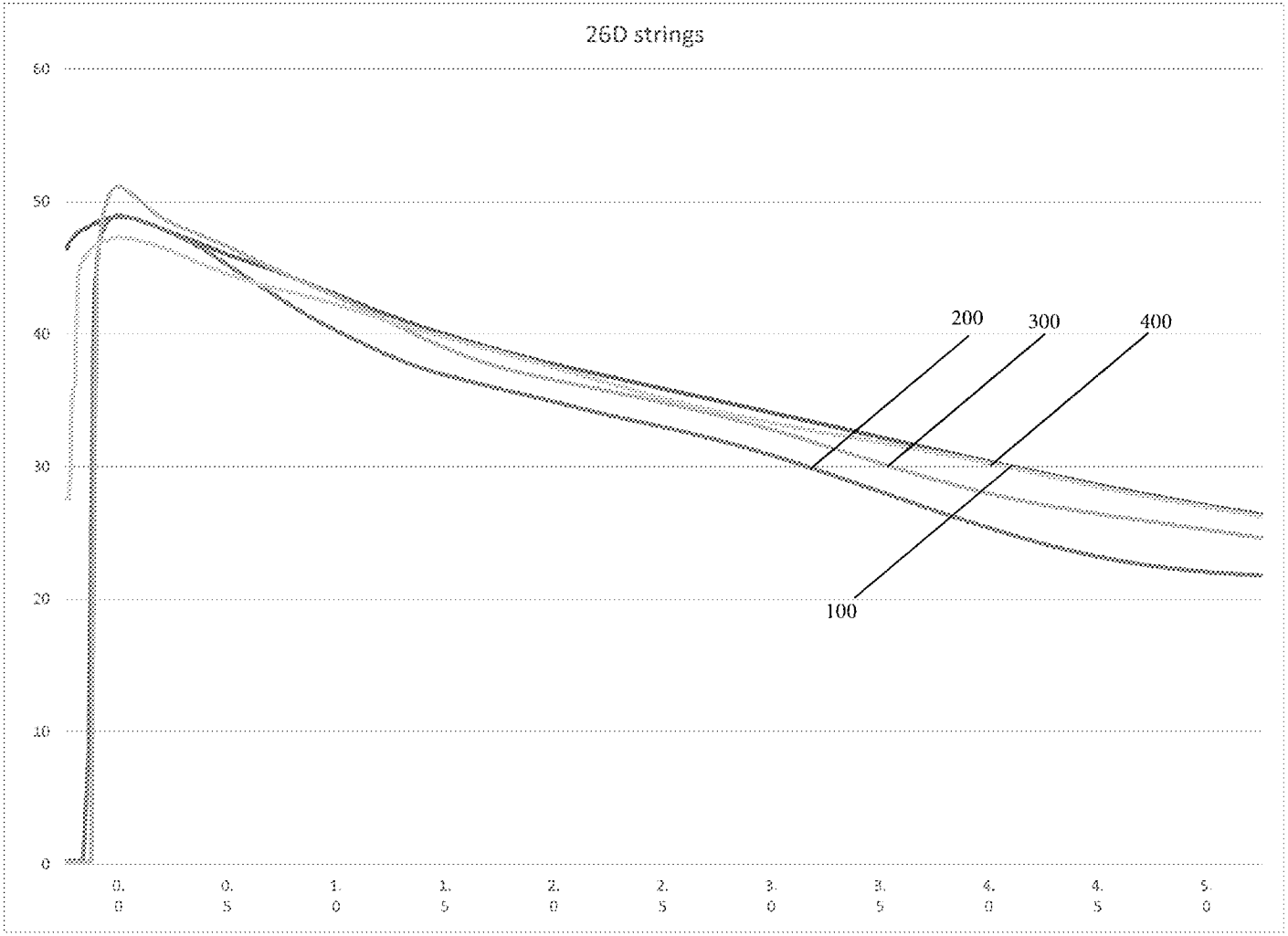
FIG. 7 is a plot of decibel levels versus time for 26D strings.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

The novel features of the disclosed methods will become apparent from the following description. Disclosed is a method of improving the decibel level decay rate of an excited musical instrument string using a non-toxic chemical preservative treatment or coating. The chemical treatment is a clear, low viscosity solution of a fluorochemical acrylate polymer carried in a hydrofluoroether solvent. The solvent is non-flammable, has low toxicity and contains no volatile organic compounds. Suitably, a string so coated will achieve improved decibel level decay with a given force of vibration when compared to an uncoated string of the same or similar physical characteristics. In one embodiment, the disclosed method comprises the step of coating a string in fluorochemical acrylate polymer with a thickness of one micron or less than one micron. This coating may be accomplished by dangling a string from a support and dipping the string in a solution of a fluorochemical acrylate polymer carried in a hydrofluoroether solvent. Suitably, the strings may be have diameters from 0.008 to 0.200 inches and be dipped for from three to thirty seconds in the solution. In certain embodiments, a string may be dipped/coated multiple times to correspondingly increase the coating thickness. For example, a string may be coated five or fewer times to get a coating of five microns or fewer, four or fewer times to get a coating of four microns or fewer, and so on. In a preferred embodiment, the solution is a two percent solution of flourochemical acrylate polymer in a hydroflouroether solvent. In another preferred embodiment, the solution is a three percent solution of flourochemical acrylate polymer in a hydroflouroether solvent.

Sound pressure tests were performed on coated and uncoated strings. For the test, a single string was mounted on a Gibson Les Paul Standard Guitar and tuned to the proper frequency. The guitar was set on a tripod in the center of an anechoic chamber with a nineteen and a half feet by nineteen feet plan and a height of fifteen feet. The volume control of the guitar was set to its maximum and the output from the guitar was fed through an anti-aliasing filter and then to an analyzer. A guillotine type mechanism was used to pass a guitar pick across the mounted string in a repeatable manner. When raised and released, the guillotine would free fall and strike the mounted string in a normal position on the guitar with the pick. FIG. 1 is a list of the equipment used to perform the test. Specifically, the test equipment included a Larson Davis 2200C PreAmp Power Supply (ser. no. 0828), a Larson Davis PRM902 Microphone PreAmp (ser. no. 0411), a Bruel & Kjaer 4165 Microphone (ser. no. 732091), and a Bruel & Kjaer 4230 Calibrator (ser. no. 861608).

Four types of strings were tested: (1) uncoated 46E, 36A and 26D strings; (2) 46E, 36A and 26D strings that were coated as disclosed above; (3) Everly brand B52s 46E, 36A and 26D strings; and (4) Cobalt brand 46E, 36A and 26D strings. In the test, the uncoated strings are the negative control and the coated strings are the positive control. The coated and uncoated strings only substantially differed by coating. The B52s and Cobalt strings were tested only for comparison and differed from both the positive and negative controls by material and construction. Neither the B52s strings nor the Cobalt strings were coated. Each string was excited five times and the voltage was recorded eighty times a second for a period of about ten seconds. The voltages were converted to decibel (dB) levels referenced to one millivolt (mV). The maximum occurring level for the five excitations were averaged arithmetically and the standard deviation determined. The data is tabulated in FIGS. 2 through 4.

FIG. 2 shows the average maximum occurring decibel level for every excitation of the 46E strings, the average of the maximum levels, and the standard deviation. The results had a standard deviation of less than one, for all strings. As shown, the coated 46E string had a slightly higher maximum decibel level than the corresponding uncoated 46E string. The coated string also had decibel levels that compared reasonably with the B52s and cobalt strings.

FIG. 3 shows the average maximum occurring decibel level for every excitation of the 36A strings, the average of the maximum levels, and the standard deviation. The results had a standard deviation of less than one, for all strings. As shown, the coated 36A string a maximum decibel level that was nearly the same as the corresponding uncoated 36A string. The coated string also had decibel levels that compared reasonably with the B52s and cobalt strings.

FIG. 4 shows the average maximum occurring decibel level for every excitation of the 26D strings, the average of the maximum levels, and the standard deviation. The results had, for the most part, a standard deviation of less than one; the Cobalt strings' results had a standard deviation of 1.72. As shown, the coated 26D string a maximum decibel level that was nearly the same as the corresponding uncoated 26D string. The coated string also had decibel levels that compared reasonably with the B52s and cobalt strings.

Referring to FIGS. 2 through 3, the maximum decibel levels for uncoated and coated strings were nearly the same and, in the case of the 46E strings, slightly higher for the uncoated strings. This observation is unexpected since it is generally understood that coating a string can negatively affect the string's maximum decibel levels. It should be noted, however, that the maximum decibel levels do not correspond directly to perceived loudness. This is because perceived loudness correlates with, among other things, the maximum decibel level of a sound and duration of the sound's decibel level. Thus, the maximum decibel level of the strings shown in FIGS. 2 through 4 have been provided in the context of the decay of the decibel levels over time. This context is shown in the remaining figures.

FIGS. 5 through 8 are a plot of the average decay in decibel level of the 46E, 36A, and 26A string excitations, over time (in seconds). In general, each time a string was exited, there was a corresponding rapid rise to the maximum decibel level followed by a decay in the decibel levels as the string continued to vibrate over the electrical pickup. Since the time required reach the maximum decibel level varied for each string set, the maximum decibel level of the string excitations were time aligned at 0.0 and compared for a period of five seconds. Referring first to FIG. 5, the decibel level 100 for the coated strings decays at a generally slower rate than the decibel level 200 of the uncoated strings, the decibel level 300 of the B52s strings, and the decibel level 400 of the Cobalt strings. The decay rate for each string was calculated by determining the slope of a linear regression for each decay curve from zero seconds to five seconds. For the 46E strings, the decay rate of the coated strings is −3.41 dB/sec, the decay rate of the uncoated strings is −4.61 dB/sec, the decay rate for B52s strings is −4.34 dB/sec, and the decay rate for Cobalt strings is −3.78 dB/sec. For the 36A strings, the decay rate of the coated strings is −4.48 dB/sec, the decay rate of the uncoated strings is −4.17 dB/sec, the decay rate for B52s strings is −4.42 dB/sec, and the decay rate for Cobalt strings is −3.50 dB/sec. For the 26D strings, the decay rate of the coated strings is −4.21 dB/sec, the decay rate of the uncoated strings is −5.12 dB/sec, the decay rate for B52s strings is −4.81 dB/sec, and the decay rate for Cobalt strings is −3.98 dB/sec. It should be noted that the linear regression for any string is: y (dB)=decay rate (dB/sec)×(sec)+Maximum Decibel Level (dB).

These results indicate that the maximum decibel level and decay rates of all the types of strings are comparable. The general difference in Maximum decibel level is slight, with less than two decibel between the different types of strings. When the maximum decibel level and decay rates are evaluated, the uncoated strings have slightly higher decibel levels than the coated strings. However, the coated strings have generally lower decay rates than the uncoated strings and that perceived loudness, which correlates with decibel levels and decay rates, is higher for coated strings.

This specification and the appended figures illustrate only typical embodiments or principles disclosed in this application, and therefore, are not to be considered limiting of its scope, for the invention may admit to other equally effective embodiments that will be appreciated by those reasonably skilled in the relevant arts. Any invention disclosed by this specification is defined by the claims.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

The claims, as originally filed, are hereby incorporated by reference in their entirety as if fully set forth herein.

I claim:

1. A method for reducing a decay rate of a decibel level of an excited musical instrument string comprising the steps of:

coating a musical instrument string with a fluorochemical acrylate polymer film of approximately 1 micron, or less, by treating said string with a solution of fluorochemical acrylate polymer solute and hydrofluoroether solvent; and, allowing the film to dry.

2. The method of claim 1 wherein the film is approximately 3 microns or less.

3. The method of claim 1 wherein the solution is approximately two percent fluorochemical acrylate polymer.

4. The method of claim 1 wherein the solution is approximately three percent fluorochemical acrylate polymer.

5. A string with a decay rate after excitement to a maximum decibel level of between approximately −3.41 decibels per second and −4.00 decibels per second.

* * * * *